US010911864B2

(12) United States Patent
Tai et al.

(10) Patent No.: US 10,911,864 B2
(45) Date of Patent: Feb. 2, 2021

(54) HEAD-MOUNTED DISPLAY APPARATUS AND ACOUSTIC DEVICE

(71) Applicants: Acer Incorporated, New Taipei (TW); STARVR CORPORATION, New Taipei (TW)

(72) Inventors: Kuei-Ting Tai, New Taipei (TW); Jia-Ren Chang, New Taipei (TW); Chun-Hung Wen, New Taipei (TW)

(73) Assignees: ACER INCORPORATED, New Taipei (TW); STARVR CORPORATION, New Taipei (TW)

( * ) Notice: Subject to any disclaimer, the term of this patent is extended or adjusted under 35 U.S.C. 154(b) by 0 days.

(21) Appl. No.: 16/546,559

(22) Filed: Aug. 21, 2019

(65) Prior Publication Data

US 2020/0077181 A1 Mar. 5, 2020

(30) Foreign Application Priority Data

Aug. 28, 2018 (TW) ..... 107130214 A

(51) Int. Cl.

| | |
|---|---|
| ***H04R 1/34*** | (2006.01) |
| ***H04R 1/02*** | (2006.01) |
| ***H04R 1/28*** | (2006.01) |
| ***H04R 7/16*** | (2006.01) |

(52) U.S. Cl.

CPC ..... *H04R 1/345* (2013.01); *H04R 1/025* (2013.01); *H04R 1/2811* (2013.01); *H04R 7/16* (2013.01); *H04R 2201/02* (2013.01); *H04R 2499/15* (2013.01)

(58) Field of Classification Search

None

See application file for complete search history.

(56) References Cited

U.S. PATENT DOCUMENTS

| | | | | |
|---|---|---|---|---|
| 2015/0129351 | A1 | 5/2015 | Wheeler | |
| 2018/0091892 | A1* | 3/2018 | Taylor | H04R 1/2811 |
| 2020/0053456 | A1* | 2/2020 | Williams | H04R 1/1008 |

FOREIGN PATENT DOCUMENTS

| | | | |
|---|---|---|---|
| CN | 101052238 | A | 10/2007 |
| CN | 205620609 | U | 10/2016 |
| EP | 1 843 627 | A1 | 10/2007 |
| EP | 3 244 631 | A1 | 11/2017 |
| JP | 08-172691 | A | 7/1996 |
| JP | 2013-093808 | A | 5/2013 |
| TW | M545413 | U | 7/2017 |

OTHER PUBLICATIONS

European Search Report dated Jan. 24, 2020, issued in application No. EP19193320.9.

Chinese language office action dated Aug. 28, 2019, issued in application No. TW 107130214.

* cited by examiner

*Primary Examiner* — Kenny H Truong

(74) *Attorney, Agent, or Firm* — McClure, Qualey & Rodack, LLP

(57) ABSTRACT

A head-mounted display apparatus and an acoustic device disposed in the head-mounted display apparatus are provided. The acoustic device includes a speaker, a resonance box, and a waveguide. The resonance box is connected to the speaker. The waveguide is connected to the resonance box. The volume of the waveguide is greater than twice the volume of the speaker, and the length of the waveguide is greater than 5 times the thickness of the speaker.

10 Claims, 9 Drawing Sheets

1

HEAD-MOUNTED DISPLAY APPARATUS AND ACOUSTIC DEVICE

CROSS-REFERENCE TO RELATED APPLICATIONS

This application claims priority of Taiwan Patent Application No. 107130214 filed on Aug. 28, 2018, the entirety of which is incorporated by reference herein.

BACKGROUND OF THE INVENTION

Field of the Invention

The present disclosure relates to a display apparatus and an acoustic device, and in particular to a head-mounted display apparatus and an acoustic device disposed in the head-mounted display apparatus.

Description of the Related Art

Conventional head-mounted displays are available on the consumer market. Conventional head-mounted displays are worn on the user's head and provide a flat image or stereoscopic image for the user to view. Conventional head-mounted displays include a display panel and two lenses, each of which corresponds to one of the user's eyes. The display panel is used to display a left-eye image and a right-eye image, which enter the left and right eyes of the user via the lenses. When the user's left eye views the left-eye image and the right eye views the right-eye image, the user perceives a stereoscopic image.

In general, when a user wears a head-mounted display, headphones are worn on the ears. However, when head-mounted displays are used by the general public in public places (such as electronic playgrounds, exhibition venues, or museums), head-mounted displays are used and re-used by many users, running the risk of spreading germs and thereby causing health problems.

Although existing head-mounted displays have been generally adequate for their intended purposes, they have not been entirely satisfactory in all respects. Consequently, it would be desirable to provide a solution for improving the head-mounted displays.

BRIEF SUMMARY OF THE INVENTION

The disclosure provides a head-mounted display apparatus. When the user wears a head-mounted display apparatus, it does not touch the user's ears yet still provides good sound quality.

The disclosure provides an acoustic device including a speaker, a resonance box, and a waveguide. The resonance box is connected to the speaker. The waveguide is connected to the resonance box. The volume of the waveguide is greater than 2 times the volume of the speaker, and the length of the waveguide is greater than 5 times the thickness of the speaker.

In some embodiments, the length of the waveguide is in a range from about 5 cm to 20 cm. In some embodiments, the resonance box and the waveguide are made of a hard material.

In some embodiments, the waveguide comprises a connection portion connected to the resonance box and an extension portion connected to the connection portion, and the extension portion extends along a wave path. In some embodiments, the extension portion substantially extends along a linear path.

In some embodiments, the maximum length of the connection portion is about 0.8 times to 5 times the maximum thickness of the extension portion, and the minimum thickness of the extension portion is in a range from about 3 mm to 8 mm.

In some embodiments, the speaker includes a speaker housing and a diaphragm, the speaker housing has a receiving cavity, and the diaphragm is disposed in the receiving cavity. The volume of the receiving cavity is in a range from about 0.6 cc to 2 cc.

In some embodiments, the waveguide has a waveguide cavity, an acoustic inlet connected to the waveguide cavity, and an acoustic outlet connected to the waveguide cavity. The acoustic inlet and the acoustic outlet of the waveguide are located at two opposite sides of the waveguide cavity, and the acoustic inlet of the waveguide faces the resonance box. The volume of the waveguide cavity is in a range from about 2 cc to 8 cc.

In some embodiments, the resonance box has a resonance cavity, an acoustic inlet connected to the resonance cavity, and an acoustic outlet connected to the resonance cavity. The acoustic inlet of the resonance box corresponds to the diaphragm, and the acoustic outlet of the resonance box faces the waveguide. The volume of the resonance cavity is less than or equal to the volume of the receiving cavity.

In some embodiments, the speaker housing further includes a receiving cavity, an acoustic surface, and an acoustic outlet formed on the acoustic surface and connected to the receiving cavity. The diaphragm is adjacent to the acoustic surface, and the resonance box is connected to the acoustic surface.

The disclosure provides a head-mounted display apparatus including a display device, an acoustic device, and a wearing structure. The display device includes an outer casing and a display panel. The outer casing includes a display portion and a wearing portion connected to the display portion. The display panel is disposed in the display portion.

The acoustic device includes a speaker, a resonance box and a waveguide. The speaker is disposed in the outer casing, and adjacent to the display panel. The resonance box is connected to the speaker. The waveguide is connected to the resonance box and the wearing portion. The wearing structure is connected to the outer casing. The volume of the waveguide is greater than 2 times the volume of the speaker. The length of the waveguide is greater than 5 times the thickness of the speaker.

In some embodiments, the display device further includes lenses disposed on the display portion and that face the display panel. In some embodiments, the speaker is located in the display portion. The waveguide has an acoustic outlet located at an end portion of the wearing portion.

In conclusion, the head-mounted display apparatus of the present disclosure can provide sound to the user without contacting the user's ears by the acoustic device, thereby reducing the health problems caused by the user wearing the head-mounted display apparatus. Moreover, the sound quality of the acoustic device can be improved by the design of the waveguide.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
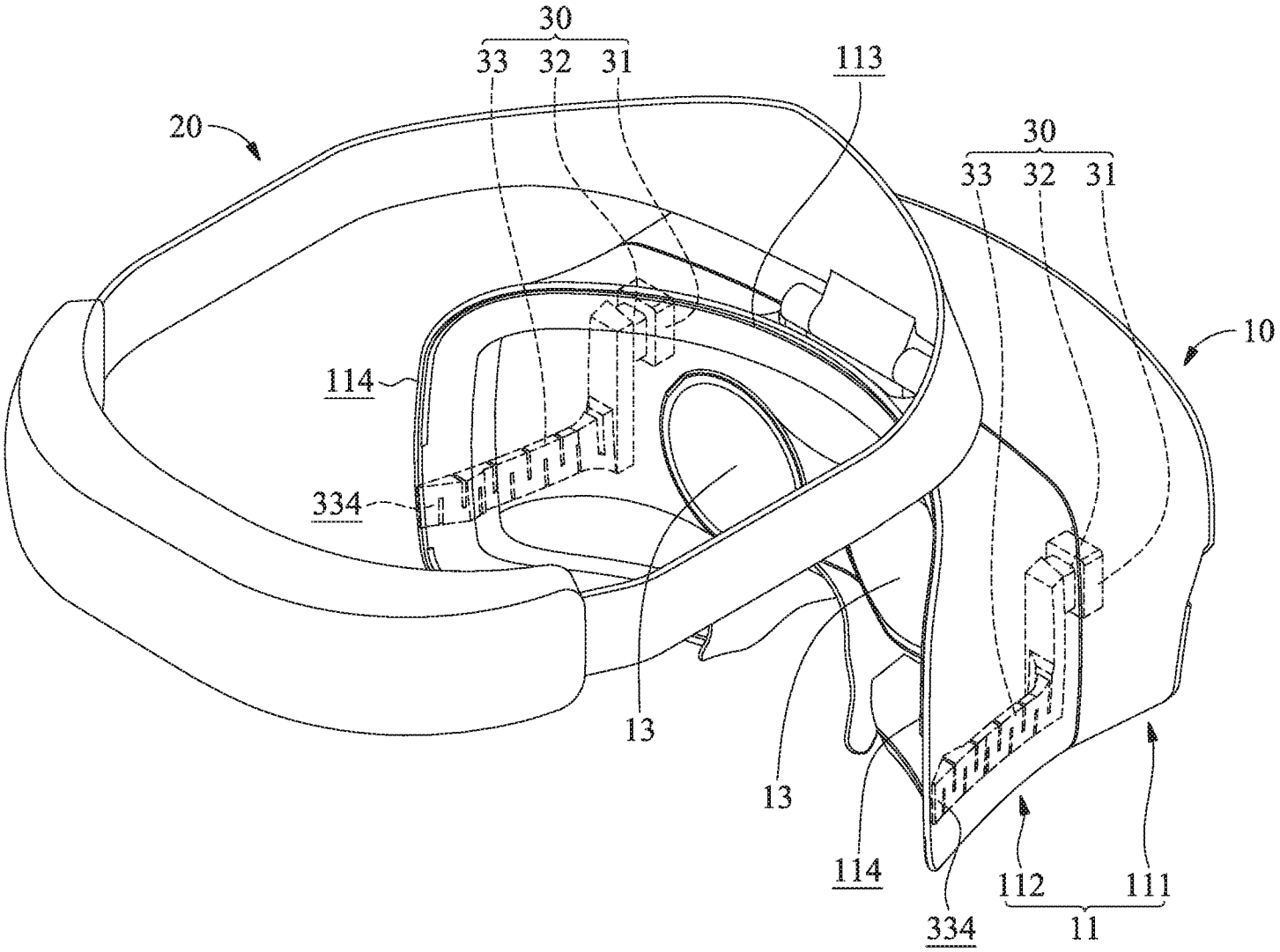
FIG. 1 is a perspective view of the head-mounted display apparatus in accordance with some embodiments of the disclosure.

The following disclosure provides many different embodiments, or examples, for implementing different features of the present disclosure. Specific examples of components and arrangements are described below to simplify the present disclosure. For example, the formation of a first feature over or on a second feature in the description that follows may include embodiments in which the first and second features are formed in direct contact, and may also include embodiments in which additional features may be formed between the first and second features, such that the first and second features may not be in direct contact.

Spatially relative terms, such as upper and lower, may be used herein for ease of description to describe one element or feature's relationship to other elements or features as illustrated in the figures. The spatially relative terms are intended to encompass different orientations of the device in use or operation in addition to the orientation depicted in the figures. Moreover, the shape, size, and thickness depicted in the drawings may not be drawn to scale or may be simplified for clarity of discussion; these drawings are merely intended for illustration.

Figure 2:
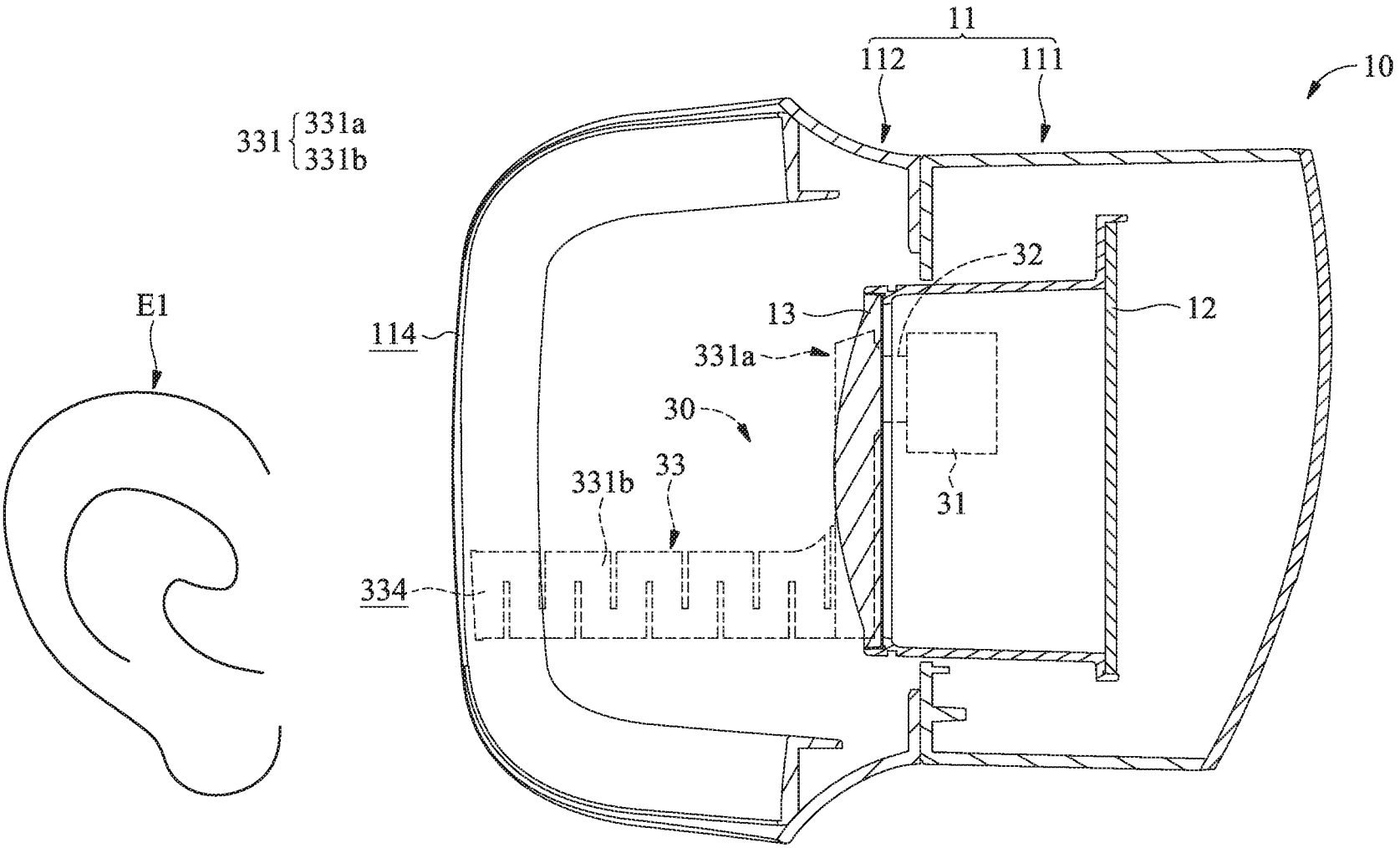
FIG. 2 is a schematic view of the display device in accordance with some embodiments of the disclosure.

FIG. 1 is a perspective view of the head-mounted display apparatus 1 in accordance with some embodiments of the disclosure. FIG. 2 is a schematic view of the display device 10 in accordance with some embodiments of the disclosure. The head-mounted display apparatus 1 can be worn on the user's head, and configured to provide a flat image or a stereoscopic image for the user to watch. In some embodiments, the head-mounted display apparatus 1 may be a head-mounted virtual reality apparatus.

The head-mounted display apparatus 1 includes a display device 10 and a wearing structure 20. The wearing structure 20 is connected to the display device 10. In this embodiment, the wearing structure 20 may be a ring structure, and pivot on the display device 10. In some embodiments, the wearing structure 20 is a U-shaped structure. Two ends of the wearing structure 20 are connected to two sides of the display device 10. When the user wears the head-mounted display apparatus 1, the wearing structure 20 can be placed on the head. Afterward, the display device 10 is attached to the face and corresponds to the eyes of the user.

The display device 10 includes an outer casing 11, a display panel 12, and two lenses 13. In this embodiment, the outer casing 11 has a display portion 111 and a wearing portion 112. The wearing portion 112 is connected to the display portion 111. In some embodiments, the wearing structure 20 pivots on the top of the display portion 111. In some embodiments, two ends of the wearing structure 20 are connected to two sides of the display portion 111 or the wearing portion 112.

The wearing portion 112 is connected to the display portion 111. The wearing portion 112 has a curved edge 113, which matches the shape of the user's face. When the user wears the head-mounted display apparatus 1, the display portion 111 is separated from the user's eye, and the curved edge 113 of the wearing portion 112 comes into contact with the user's face.

The display panel 12 is disposed in the display portion 111 of the outer casing 11. The display panel 12 may be a liquid-crystal display panel (LCD panel) or an organic light-emitting diode panel (OLED panel), and configured to display an image. In some embodiments, the display panel 12 may be a screen of a mobile device such as a mobile phone.

In some embodiments, the image includes a left-eye image and a right-eye image. The left-eye image corresponds to the user's left eye, and the right-eye image corresponds to the user's right eye. In some embodiments, there are two display panels 12. One of the display panels 12 displays the left-eye image, and the other displays the right-eye image. The left-eye image may be the same or different than the right-eye image.

The lenses 13 are disposed on the display portion 111 of the outer casing 11, and face the display panel 12. The lenses 13 are close to the wearing portion 112. In this embodiment, the lenses 13 are convex lenses. When the user wears the head-mounted display apparatus 1, each of the lenses 13 corresponds to one of the user's eyes. In some embodiments, there are at least four lenses 13. Some of the lenses 13 correspond to the user's left eye, and some of the lenses 13 correspond to the user's right eye.

The image generated by the display panel 12 is projected to the left and right eyes of the user via the lenses 13. When the head-mounted display apparatus 1 provides a stereoscopic image (3D image), the display panel 12 displays a left-eye image and a right-eye image that is different than the left-eye image. When the user's left eye sees the left-eye image and the right eye sees the right-eye image, the user perceives a stereoscopic image.

When the head-mounted display apparatus 1 provides a flat image (2D image), the display panel 12 displays a left-eye image and a right-eye image, wherein the right-eye image is the same as the left-eye image. When the user's left eye sees the left-eye image and the right eye sees the right-eye image, the user perceives a flat image.

Figure 3:
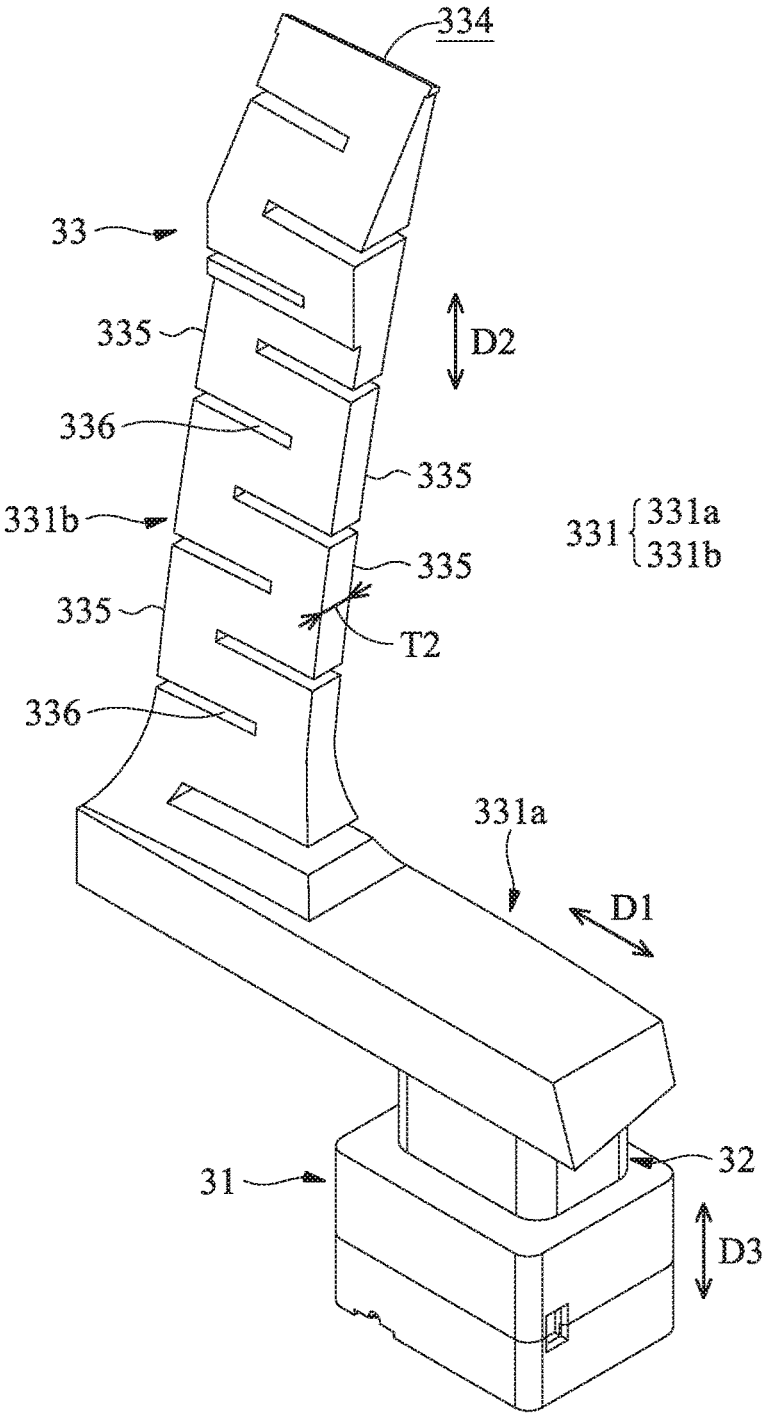
FIG. 3 is a perspective view of the acoustic device in accordance with the first embodiment of the disclosure.
Figure 4:
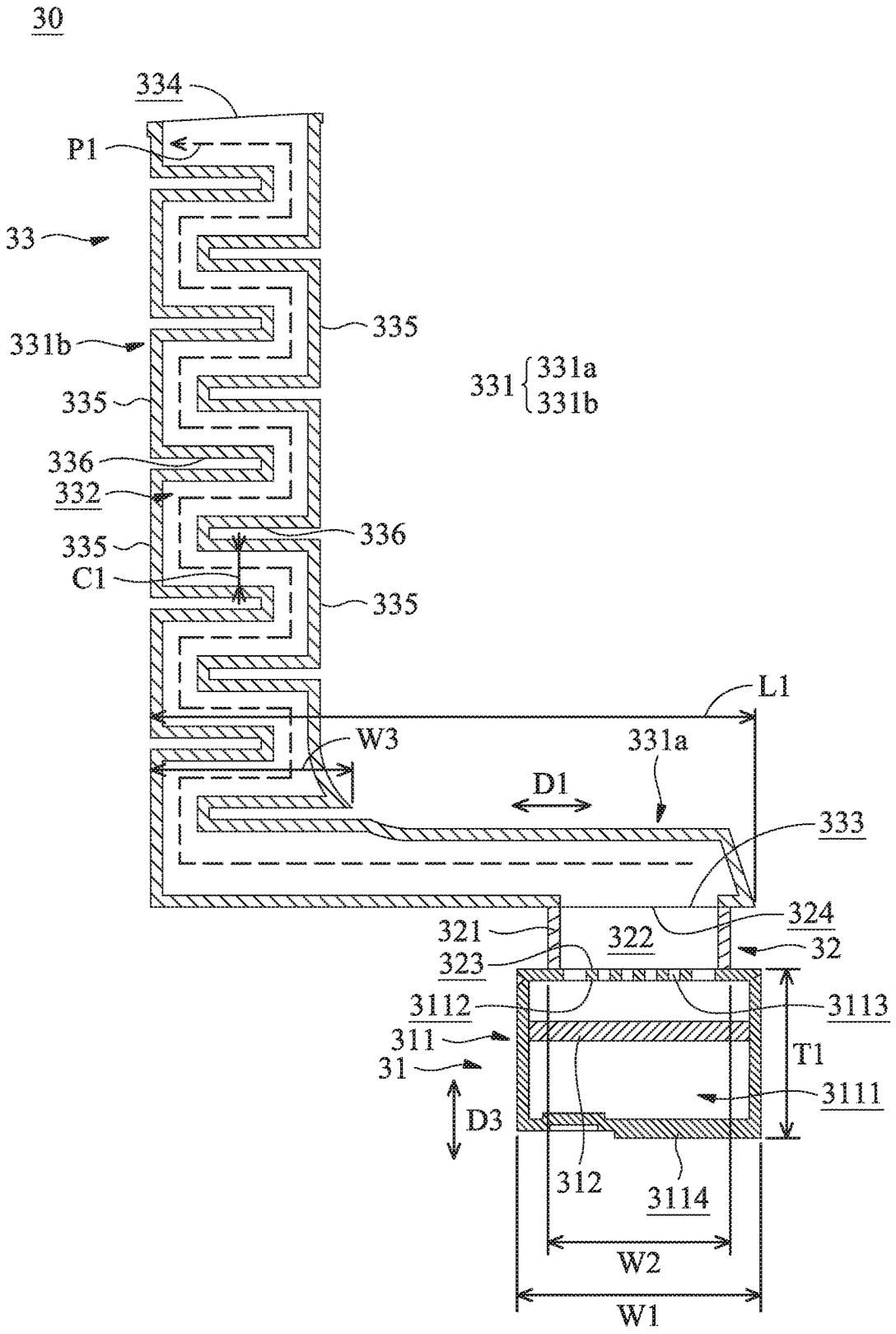
FIG. 4 is a schematic view of the acoustic device in accordance with the first embodiment of the disclosure.

FIG. 3 is a perspective view of the acoustic device 30 in accordance with the first embodiment of the disclosure. FIG. 4 is a schematic view of the acoustic device 30 in accordance with the first embodiment of the disclosure. The head-mounted display apparatus 1 further includes an acoustic device 30. The acoustic device 30 is disposed in the display device 10, and is configured to provide sound.

The acoustic device 30 includes a speaker 31, a resonance box 32, and a waveguide 33. The speaker 31 is disposed on the display portion 111 of the outer casing 11, adjacent to the display panel 12. In some embodiments, the speaker 31 is disposed in the wearing portion 112, and adjacent to the display portion 111.

The resonance box 32 is connected to the speaker 31, and located in the display portion 111. In some embodiments, the resonance box 32 is connected to the wearing portion 112.

The waveguide 33 is connected to the resonance box 32, and may be connected to the wearing portion 112. In some embodiments, the waveguide 33 is embedded in the wearing portion 112.

When the user wears the head-mounted display apparatus 1, the acoustic outlet 334 of the waveguide 33 is close to the user's ears E1. The sound generated by the speaker 31 enters into the waveguide 33 via the resonance box 32, and transmits to the user's ears E1 via the acoustic outlet 334.

In some embodiments, the distance between the acoustic outlet 334 and the user's ears E1 is in a range from about 1 cm to 10 cm. In this embodiment, the distance between the acoustic outlet 334 and the user's ears E1 is about 5 cm. By using the acoustic device 30 away from the user's ears E1, the health problems caused by the user wearing the head-mounted display apparatus 1 can be reduced. Moreover, when the head-mounted display apparatus 1 is worn on the head of different users, the acoustic device 30 does not easily come in contact with the users' ears E1.

Furthermore, since the user does not need to wear an earphone on the ear, the time required for the user to put on and take off the head-mounted display apparatus 1 can be reduced.

The speaker 31 includes a speaker housing 311 and a diaphragm 312. The speaker housing 311 has a receiving cavity 3111, an acoustic surface 3112, one or more acoustic outlets 3113, and a rear surface 3114 opposite to the acoustic surface 3112. The receiving cavity 3111 is located in the speaker housing 311. The acoustic outlet 3113 is formed on the acoustic surface 3112, and connected to the receiving cavity 3111. In some embodiments, the volume of the receiving cavity 3111 is in a range from about 0.6 cc to 2 cc. In this embodiment, the volume of the receiving cavity 3111 is about 1 cc.

The diaphragm 312 is disposed in the receiving cavity 3111. The diaphragm 312 is adjacent to the acoustic surface 3112, and far from the rear surface 3114. In this embodiment, the diaphragm 312 generates sound by vibrating diaphragm 312, and the sound generated by the diaphragm 312 may resonate within the receiving cavity 3111. Moreover, the sound generated by the diaphragm 312 is transmitted to the resonance box 32 via the acoustic surface 3112 and the acoustic outlet 3113.

In this embodiment, the diaphragm 312 extends in an extension direction D1. The acoustic surface 3112 may be parallel to the diaphragm 312 and the extension direction D1.

The resonance box 32 is connected to the acoustic surface 3112 of the speaker housing 311. The resonance box 32 may be made of a hard material, such as hard plastic or metal. The resonance box 32 includes a resonance housing 321. The resonance housing 321 has a resonance cavity 322, an acoustic inlet 323, and an acoustic outlet 324. The acoustic inlet 323 is connected to the resonance cavity 322, and corresponds to the acoustic outlet 3113 of the speaker housing 311 and the diaphragm 312. The acoustic outlet 324 is connected to the resonance cavity 322, and opposite to the acoustic inlet 323. The acoustic outlet 324 faces the acoustic inlet 333 of the waveguide 33, and face the acoustic inlet 323. The acoustic inlet 323 and the acoustic outlet 324 may be parallel to the diaphragm 312.

In this embodiment, the volume of the resonance cavity 322 is less than or equal to the volume of the receiving cavity 3111. In some embodiments, the volume of the resonance cavity 322 may be 0.5 times to 1 time the volume of the receiving cavity 3111. The volume of the resonance cavity 322 may be in a range from about 0.3 cc to 2 cc.

In this embodiment, the width W1 of the speaker 31 is about 1 time to 1.5 times the width W2 of the resonance box 32. In this embodiment, the width W1 of the speaker 31 may be 1.1 or 1.2 times the width W2 of the resonance box 32. The widths W1 and W2 are measured in the extension direction D1.

The waveguide 33 is connected to the resonance box 32. The waveguide 33 may be made of a hard material, such as hard plastic or metal. The volume of the waveguide 33 is greater than 2 or 3 times the volume of the speaker 31. In some embodiments, the volume of the waveguide 33 is about 2 times to 8 times the volume of the speaker 31.

In this embodiment, the waveguide 33 substantially extends in an extension direction D2, and the waveguide 33 extends along a wave path P1. In the disclosure, the length of the waveguide 33 is measured along the wave path P1. The length of the waveguide 33 is greater than 5 times the thickness T1 of the speaker 31. In some embodiments, the length of the waveguide 33 is 5 times to 15 times the thickness T1 of the speaker 31. The thickness T1 of the speaker 31 is measured in an extension direction D3.

In this embodiment, the length of the waveguide 33 is in a range from about 5 cm to 20 cm. In this embodiment, the length of the waveguide 33 is about 15 cm. The thickness T1 of the speaker 31 is in a range from about 0.5 cm to 1.5 cm. In this embodiment, the thickness T1 of the speaker 31 is about 0.8 cm.

In this embodiment, the extension direction D2 is substantially perpendicular to the extension direction D1. The extension direction D3 may be substantially perpendicular to extension direction D1. The extension direction D2 is inclined relative to the extension direction D3. The angle between the extension direction D2 and the extension direction D3 is less than 30 degrees.

The waveguide 33 includes a waveguide housing 331. The waveguide housing 331 has a waveguide cavity 332, an acoustic inlet 333, and an acoustic outlet 334. The volume of the waveguide cavity 332 is in a range from about 2 cc to 8 cc. In this embodiment, the volume of the waveguide cavity 332 is about 3 cc. The volume of the waveguide 33 is greater than 2 or 3 times the volume of the speaker 31. In some embodiments, the volume of the waveguide 33 is about 2 times to 8 times the volume of the speaker 31.

The minimum cross-sectional area C1 of the waveguide cavity 332 perpendicular to the extension direction D1 is in a range from about 8 square millimeters to 60 square millimeters. In some embodiments, the minimum cross-sectional area C1 of the waveguide cavity 332 perpendicular to the extension direction D1 is about 9 square millimeters.

The acoustic inlet 333 is connected to the waveguide cavity 332, and faces the resonance box 32. In this embodiment, the acoustic inlet 333 is connected to the acoustic outlet 324. The acoustic outlet 334 is connected to the waveguide cavity 332. The acoustic inlet 333 and the acoustic outlet 334 are located at two opposite sides of the waveguide cavity 332.

The area of the acoustic outlet 334 is in a range from about 6 square millimeters to 20 square millimeters. In this embodiment, the area of the acoustic outlet 334 is about 9 square millimeters. As shown in FIG. 1 and FIG. 2, the acoustic outlet 334 is located at the end portion 114 of the wearing portion 112.

In this embodiment, the waveguide housing 331 includes a connection portion 331*a* and an extension portion 331*b*. The connection portion 331*a* is connected to the resonance box 32, and the extension portion 331*b* is connected to the connection portion 331*a*. The connection portion 331*a* may substantially extend in the extension direction D1. The extension portion 331*b* may substantially extend in the extension direction D2. In this embodiment, the extension portion 331*b* extends along a wave path P1. As shown in FIG. 1, the extension portion 331*b* extends to the end portion 114 of the wearing portion 112 along the side wall of the wearing portion 112.

The length of the connection portion 331*a* may be adjusted according to the positions of the acoustic outlet 334 of the waveguide 33 and the speaker 31. The maximum length L1 of the connection portion 331*a* is about 0.8 times to 5 times the maximum thickness W3 of the extension portion 331*b*. In this embodiment, the maximum length L1 of the connection portion 331*a* is about 2 times the maximum thickness W3 of the extension portion 331*b*. The maximum length L1 and the maximum thickness W3 are measured in the extension direction D1. The minimum thickness T2 of the extension portion 331*b* is in a range from about 3 mm to 8 mm. The minimum thickness T2 is measured in a direction that is perpendicular to the extension direction D1.

In this embodiment, the extension portion 331*b* includes longitudinal sections 335 and transverse sections 336. The longitudinal sections 335 are connected to the transverse sections 336. For example, two of the longitudinal sections 335 are connected to two ends of one of the transverse sections 336. The longitudinal sections 335 and the transverse sections 336 are alternately arranged along the wave path P1. In some embodiments, the longitudinal sections 335 are parallel to each other, and extend in the extension direction D1. The transverse sections 336 are parallel to each other, and extend in the extension direction D2.

In this embodiment, in order to install the speaker 31 to the head-mounted display apparatus 1, the size and power of the speaker 31 are limited. Therefore, the sound generated by speaker 31 has less bass, which makes it harder for the sound quality of the speaker 31 to meet requirements. For example, speaker 31 has about 5 W of power.

However, with the structure and size of the waveguide 33 (and the resonance box 32), the sound generated by the acoustic device 30 may be of good quality and have sufficient bass. Therefore, the head-mounted display apparatus 1 of the present disclosure may provide good quality sound even when the acoustic device 30 does not come into direct contact with the user's ears E1.

Figure 5:
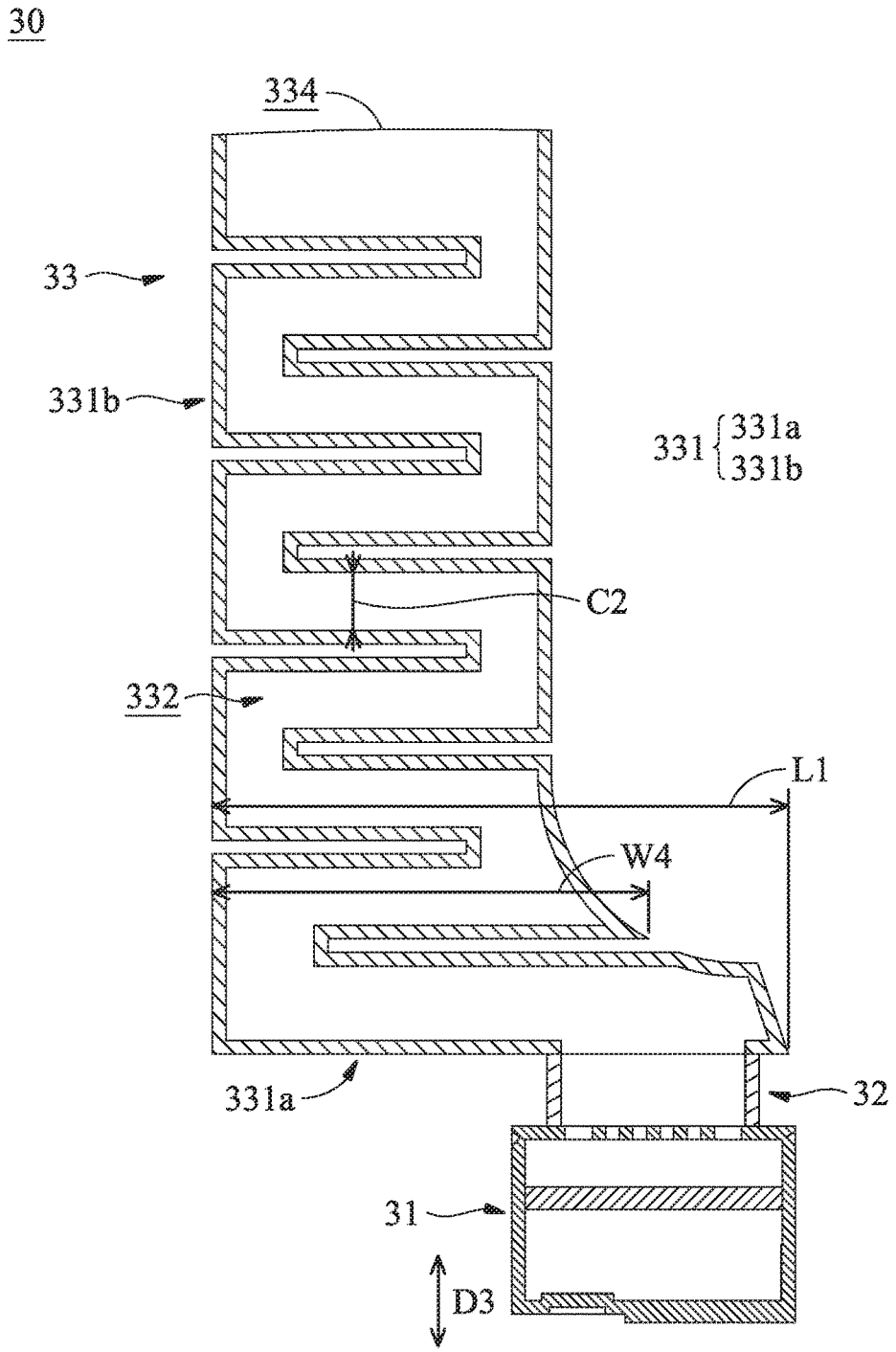
FIG. 5 is a schematic view of the acoustic device in accordance with the second embodiment of the disclosure.

FIG. 5 is a schematic view of the acoustic device 30 in accordance with the second embodiment of the disclosure. In this embodiment, the volume of the waveguide cavity 332 is about 3.8 cc. The length of the waveguide 33 is about 17 cm. The minimum cross-sectional area C2 of the waveguide cavity 332 perpendicular to the extension direction D1 is about 12 square millimeters. The area of the acoustic outlet 334 is about 15 square millimeters.

In this embodiment, the maximum thickness W4 of the extension portion 331*b* is greater than the maximum thickness W3 of the extension portion 331*b* in the first embodiment. The maximum length L1 of the connection portion 331*a* is about 1.2 times the maximum thickness W4 of the extension portion 331*b*.

Figure 6:
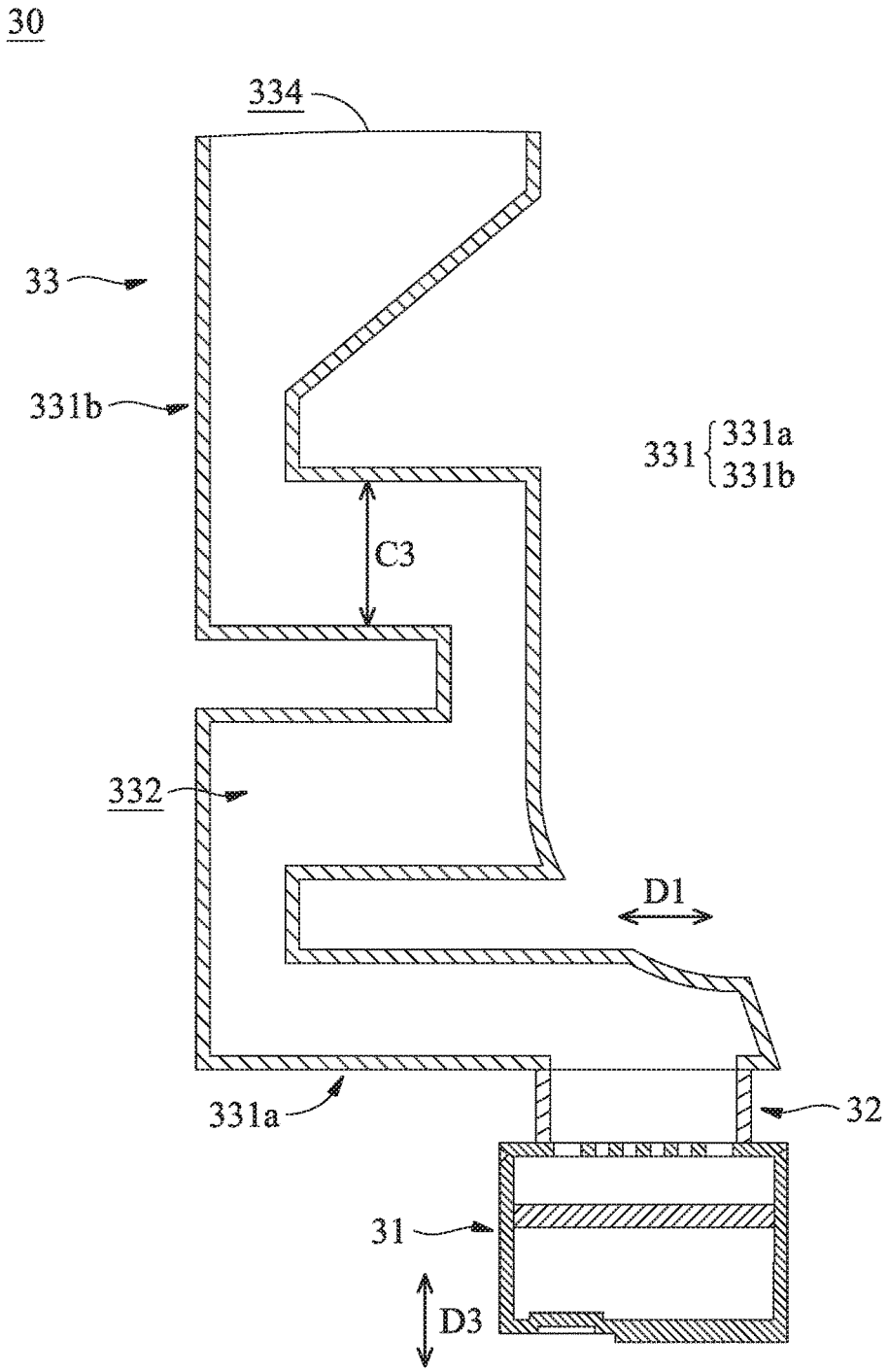
FIG. 6 is a schematic view of the acoustic device in accordance with the third embodiment of the disclosure.

FIG. 6 is a schematic view of the acoustic device 30 in accordance with the third embodiment of the disclosure. In this embodiment, the volume of the waveguide cavity 332 is about 3.4 cc. The length of the waveguide 33 is about 10 cm. The minimum cross-sectional area C3 of the waveguide cavity 332 perpendicular to the extension direction D1 is about 23 square millimeters. The area of the acoustic outlet 334 is about 15 square millimeters.

Figure 7:
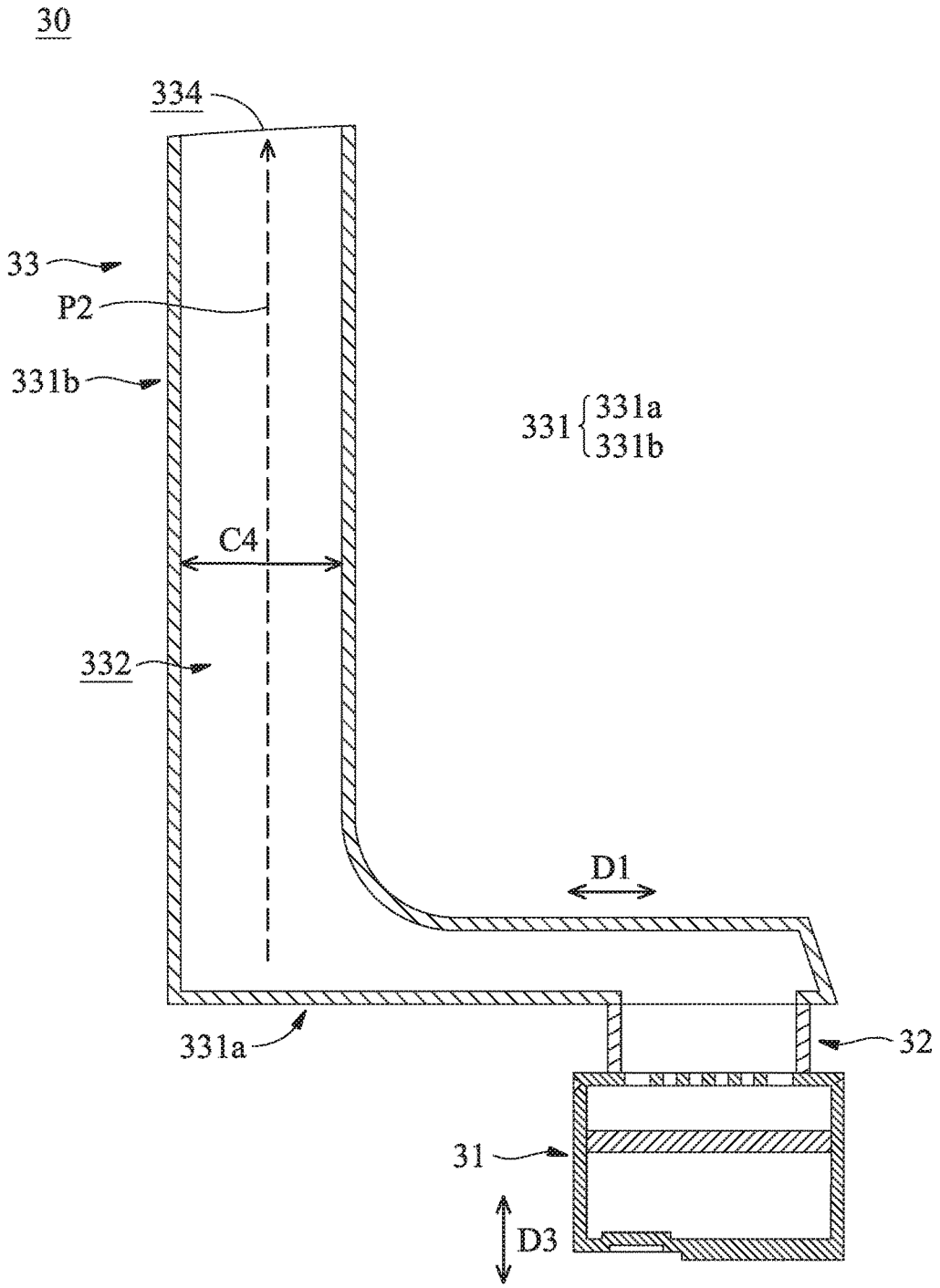
FIG. 7 is a schematic view of the acoustic device in accordance with the fourth embodiment of the disclosure.

FIG. 7 is a schematic view of the acoustic device 30 in accordance with the fourth embodiment of the disclosure. In this embodiment, the waveguide 33 are L-shaped. The extension portion 331*b* extends along a linear path P2. The linear path P2 is perpendicular to the extension direction D1, and extends in the extension direction D2 (such as FIG. 3).

In this embodiment, the volume of the waveguide cavity 332 is about 3.3 cc. The length of the waveguide 33 is about 7 cm. The minimum cross-sectional area C4 of the waveguide cavity 332 perpendicular to the linear path P2 is about 27 square millimeters. The area of the acoustic outlet 334 is about 9 square millimeters.

Figure 8:
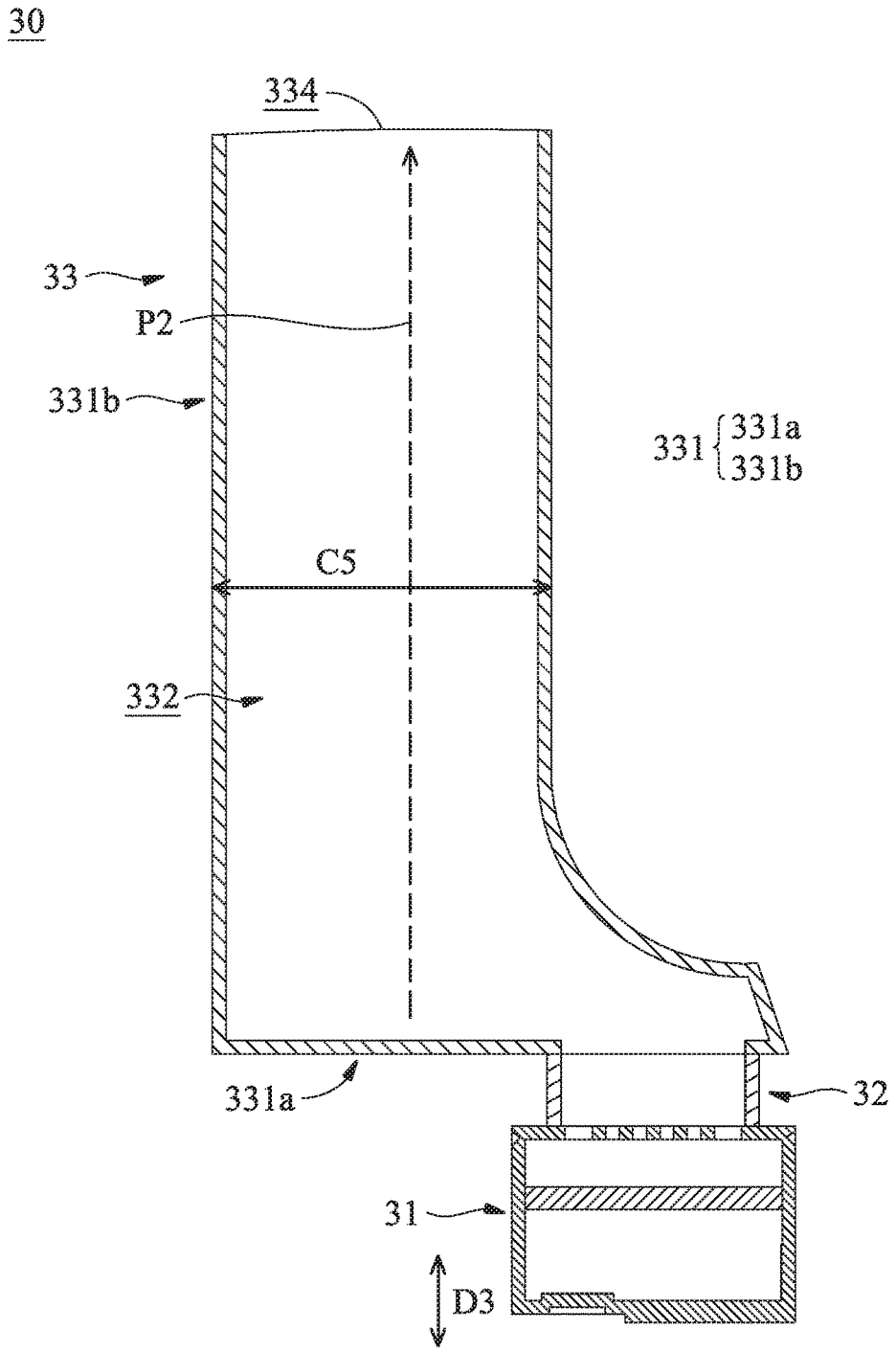
FIG. 8 is a schematic view of the acoustic device in accordance with the fifth embodiment of the disclosure.

FIG. 8 is a schematic view of the acoustic device 30 in accordance with the fifth embodiment of the disclosure. In this embodiment, the waveguide 33 is L-shaped. The extension portion 331*b* extends along a linear path P2. In this embodiment, the volume of the waveguide cavity 332 is about 4.2 cc. The length of the waveguide 33 is about 5 cm. The minimum cross-sectional area C5 of the waveguide cavity 332 perpendicular to the linear path P2 is about 46 square millimeters. The area of the acoustic outlet 334 is about 15 square millimeters.

Figure 9:
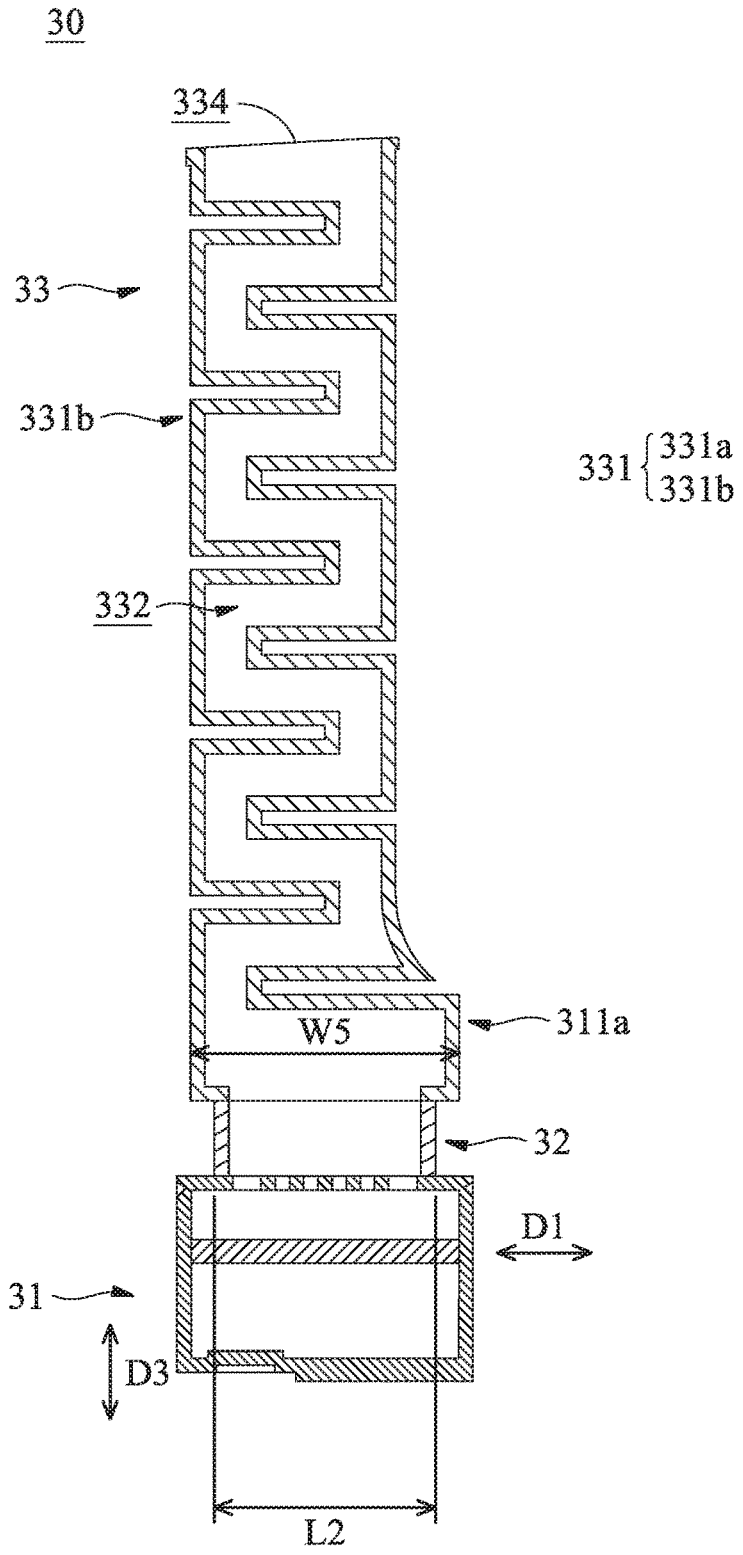
FIG. 9 is a schematic view of the acoustic device in accordance with the sixth embodiment of the disclosure.

FIG. 9 is a schematic view of the acoustic device 30 in accordance with the sixth embodiment of the disclosure. In this embodiment, the maximum length L2 of the connection portion 331*a* is about 1 time the maximum thickness W5 of the extension portion 331*b*. The speaker 31, the resonance box 32, the connection portion 331*a*, and the extension portion 331*b* are substantially arranged in the extension direction D2 (as shown in FIG. 3) or the extension direction D3. In other words, the speaker 31, the resonance box 32, the connection portion 331*a*, and the extension portion 331*b* are substantially arranged perpendicular to the extension direction D1.

The first to fifth embodiments of the present disclosure may be based on the design of the connection portion 331*a* of this embodiment. Accordingly, the speaker 31, the resonance box 32, the connection portion 331*a*, and the extension portion 331*b* can be substantially arranged in the extension direction D2 (as shown in FIG. 3) or in the extension direction D3 in order to match the positions of the speaker 31 and the acoustic outlet 334 in the outer casing 11.

In conclusion, the head-mounted display apparatus of the present disclosure can provide sound to the user without contacting the user's ears by the acoustic device, thereby reducing the health problems caused by the user wearing the head-mounted display apparatus. Moreover, the sound quality of the acoustic device can be improved by the design of the waveguide.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A head-mounted display apparatus, comprising:

a display device comprising:

an outer casing comprising a display portion and a wearing portion connected to the display portion; and a display panel disposed in the display portion;

an acoustic device comprising:

a speaker disposed in the outer casing, and adjacent to the display panel;

a resonance box connected to the speaker; and a waveguide connected to the resonance box and the wearing portion; and a wearing structure connected to the outer casing, wherein a volume of the waveguide is greater than 2 times a volume of the speaker, and a length of the waveguide is greater than 5 times the thickness of the speaker.

2. The head-mounted display apparatus as claimed in claim 1, wherein the display device further comprises a plurality of lenses that are disposed on the display portion and that face the display panel.

3. The head-mounted display apparatus as claimed in claim 1, wherein the speaker is located in the display portion, and the waveguide has an acoustic outlet located at an end portion of the wearing portion.

4. The head-mounted display apparatus as claimed in claim 1, wherein the length of the waveguide is in a range from about 5 cm to 20 cm, wherein the waveguide comprises a connection portion connected to the resonance box and an extension portion connected to the connection portion, and the extension portion extends along a wave path.

5. The head-mounted display apparatus as claimed in claim 1, wherein the waveguide comprises a connection portion connected to the resonance box, and an extension portion connected to the connection portion, and the extension portion substantially extends along a linear path, wherein the resonance box and the waveguide are made of a hard material.

6. The head-mounted display apparatus as claimed in claim 1, wherein the waveguide comprises a connection portion connected to the resonance box and an extension portion connected to the connection portion, wherein a maximum length of the connection portion is about 0.8 times to 5 times the maximum thickness of the extension portion, and the minimum thickness of the extension portion is in a range from about 3 mm to 8 mm.

7. The head-mounted display apparatus as claimed in claim 1, wherein the speaker comprises a speaker housing and a diaphragm, the speaker housing has a receiving cavity, and the diaphragm is disposed in the receiving cavity, wherein a volume of the receiving cavity is in a range from about 0.6 cc to 2 cc.

8. The head-mounted display apparatus as claimed in claim 7, wherein the waveguide has a waveguide cavity, an acoustic inlet connected to the waveguide cavity, and an acoustic outlet connected to the waveguide cavity, wherein the acoustic inlet and the acoustic outlet of the waveguide are located at two opposite sides of the waveguide cavity, the acoustic inlet of the waveguide faces the resonance box, and a volume of the waveguide cavity is in a range from about 2 cc to 8 cc.

9. The head-mounted display apparatus as claimed in claim 7, wherein the resonance box has a resonance cavity, an acoustic inlet connected to the resonance cavity, and an acoustic outlet connected to the resonance cavity, wherein the acoustic inlet of the resonance box corresponds to the diaphragm, the acoustic outlet of the resonance box faces the waveguide, and a volume of the resonance cavity is less than or equal to the volume of the receiving cavity.

10. The head-mounted display apparatus as claimed in claim 7, wherein the speaker housing further comprises a receiving cavity, an acoustic surface, and an acoustic outlet formed on the acoustic surface and connected to the receiving cavity, wherein the diaphragm is adjacent to the acoustic surface, and the resonance box is connected to the acoustic surface.

* * * * *